United States Patent [19]

Majkrzak

[11] Patent Number: 4,486,725

[45] Date of Patent: Dec. 4, 1984

[54] PROTECTIVE SHEATH FOR A WAVEGUIDE SUSPENDED ABOVE GROUND

[75] Inventor: Charles P. Majkrzak, Nutley, N.J.

[73] Assignee: International Telephone and Telegraph Corporation, New York, N.Y.

[21] Appl. No.: 410,806

[22] Filed: Aug. 23, 1982

[51] Int. Cl.[3] ..... H01P 1/30

[52] U.S. Cl. ..... 333/248; 138/107

[58] Field of Search ..... 333/248, 239; 343/872, 343/873, 886; 138/106, 107

[56] References Cited

U.S. PATENT DOCUMENTS

| | | | |
|---|---|---|---|
| 2,003,732 | 6/1935 | Bins | 138/107 X |
| 3,605,046 | 9/1971 | Miller | 333/248 X |
| 3,609,603 | 9/1971 | Lutchansky | 333/248 X |
| 3,748,606 | 7/1973 | Kaufman et al. | 333/248 X |
| 3,965,448 | 6/1976 | Browning | 333/248 |
| 4,180,102 | 12/1979 | Larkin | 138/107 X |

FOREIGN PATENT DOCUMENTS

| | | | |
|---|---|---|---|
| 2136176 | 2/1973 | Fed. Rep. of Germany | 138/107 |

*Primary Examiner*—Paul L. Gensler

*Attorney, Agent, or Firm*—John T. O'Halloran; Jeffrey P. Morris; Alfred C. Hill

[57] ABSTRACT

The arrangement to support a waveguide for transportation and handling and to support and protect a horizontal waveguide having a plurality of waveguide sections connected to each other in tandem suspended between two given spaced points comprises a plurality of shrouds each encasing a substantial length of a different one of the plurality of sections for support and protection thereof and a suspension means fastened to each end of each of the plurality of shrouds to suspend each of the plurality of waveguide sections from a cable extending between the two given spaced points.

55 Claims, 26 Drawing Figures

PROTECTIVE SHEATH FOR A WAVEGUIDE SUSPENDED ABOVE GROUND

BACKGROUND OF THE INVENTION

The present invention relates to waveguides and more particularly to an arrangement to protect a waveguide section during transport and handling and also to support and protect a horizontal waveguide having a plurality of waveguide sections connected to each other in tandem suspended between two given spaced points.

For various practical reasons regarding roughness of terrain, personnel and vehicular traffic and required performance in communication, the transmission line in the form of a waveguide from the radio shelter to its remote antenna mast is usually suspended from a structural cable. This transmission line is very critical to the performance of the radio transmitter and receiver, particularly where the operating frequencies are in the fifteen gigahertz range. Such frequencies require a waveguide of small cross section making it quite vulnerable to damage. The buckling of its wall at any point in the run, because of excessive or accidental bending, can produce catastrophic results in communications. One method of reducing this vulnerablility to damage and buckling is to encase the waveguide for protection in handling and for limiting severe bending found in suspension, wind and ice loads.

The external cross sectional dimensions for the required copper waveguide are 0.475 inches×0.850 inches with a 0.050 inch wall. Since a practical length of this waveguide is 62 inches for each section, the slenderness ratio L/R of 165 makes it very susceptible to buckling when subjected to the bending moments developed in a long continuous run suspended from a cable. Obviously, relief through increased structural strength for the section is necessary to establish and increase reliability.

SUMMARY OF THE INVENTION

An object of the present invention is to provide a protective sheathing arrangement for each waveguide section whereby the resulting composite structure will accept the anticipated loads and deformations appropriately and safely.

Another object of the present invention is to provide an arrangement to protect waveguide sections during transport and handling and to support and protect a plurality of waveguide sections connected to each other in tandem suspended between two given spaced points.

A feature of the present invention is the provision of an arrangement to support and protect a horizontal waveguide having a plurality of waveguide sections connected to each other in tandem suspended between two given spaced points comprising a cable extending between the two points; a plurality of shrouds each encasing a substantial length of a different one of the plurality of sections for support and protection thereof; and a suspension means fastened to each end of each of the plurality of shrouds to suspend each of the plurality of sections from the cable.

Another feature of the present invention is to provide a protective sheathing for a waveguide including a plurality of waveguide sections to be connected to each other in tandem and suspended between two given spaced points comprising a plurality of shrouds each encasing a substantial length of a different one of the plurality of sections, each of the plurality of shrouds including two symmetrical halves which when mated to one another provides a cavity therein to receive an associated one of the plurality of sections.

In accordance with the principles of the present invention, a multipurpose protective sheathing is provided for fragile waveguide sections used in the field. The protective sheathing protects such section in rough handling and transport, and broadens the scope of tolerable installation conditions. The sheathing permits the waveguide array to assume and retain catenary configuration under varying loads minimizing inflections and detrimental local stresses. The sheathing directly accepts the ice and wind loading and, in a preferred embodiment, eliminates the need for sections of flexible waveguide in the span with their inherently greater losses in electrical performance and higher costs.

BRIEF DESCRIPTION OF THE DRAWING

Above-mentioned and other features and objects of this invention will become more apparent by reference to the following description taken in conjunction with the accompanying drawing, in which.

DESCRIPTION OF THE PREFERRED EMBODIMENTS

Figure 4:
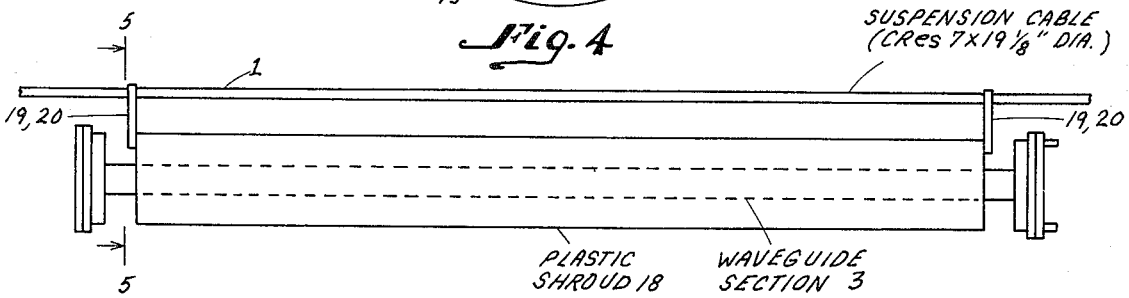
FIG. 4 is an elevational view of a second embodiment of the support and protection arrangement in accordance with the principles of the present invention.

To assist in explaining the principles behind the present invention, let us assume a communication installation requiring the bridging of a 44 ft. span from the radio shelter to the antenna mast. This implies the use of eight waveguide sections in the run. The suspension cable may have a tightening mechanism with the cable suspending the waveguide sections above ground. The suspension cable 1 illustrated in FIGS. 1 and 4 is a $\frac{1}{8}$ inch diameter, CRes 7×19, aircraft cable, which has a breaking strength of 1760 lbs.

Connecting flanges are brazed to the hard drawn copper waveguide lengths or sections and each interface is required to withstand 500 inch-pounds of bending moment. The normal yield strength of 35,000 PSI (pounds per square inch) for the waveguide length is reduced to 10,000 PSI in the vicinity of the brazed joints.

Figure 1:
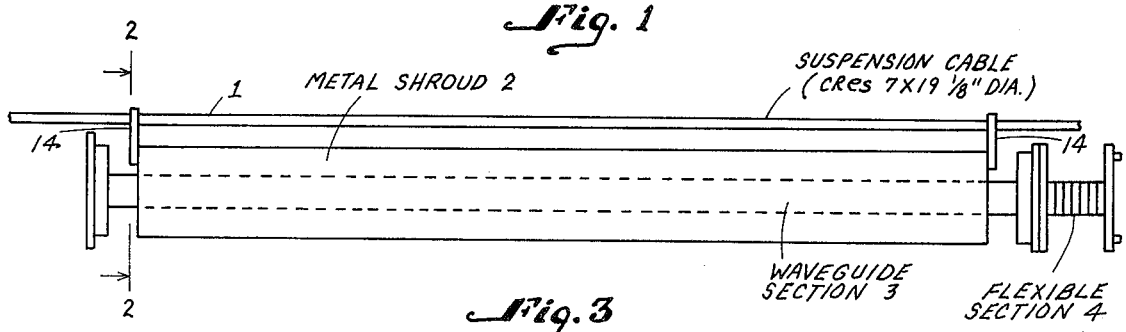
FIG. 1 is an elevational view of one embodiment of the support and protection arrangement in accordance with the principles of the present invention.

Referring to FIG. 1, one embodiment of a protective sheathing for each waveguide section is a metal shroud 2 to protect each waveguide section against abusive handling and excessive bending loads. The metal of shroud 2 may be aluminum. In the suspension of a horizontal run of waveguide, including a plurality of waveguide sections each enclosed within a shroud 2, ice loads are carried by the shroud. A short flexible section 4 permits angular deviation between waveguide sections to eliminate bending stresses.

Figure 3:
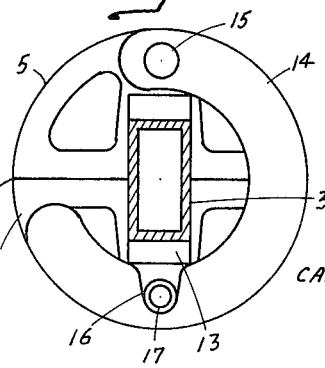
FIG. 3 is an end view of the waveguide and protective sheathing of FIGS. 1 and 2, with the suspension link disposed in its transport position.
Figure 5:
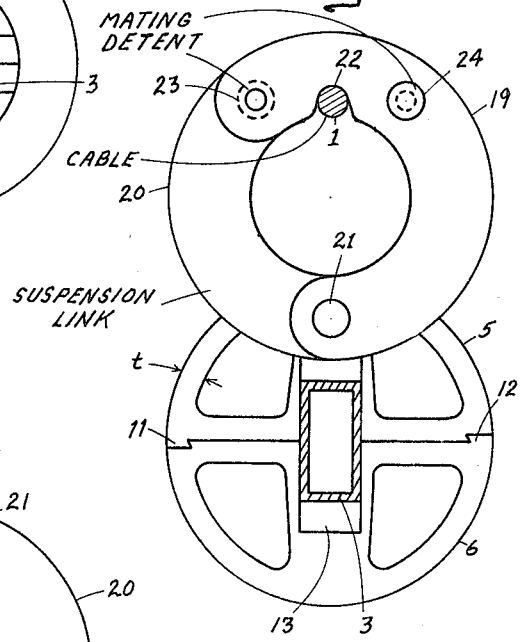
FIG. 5 is an end view taken along line 5—5 of FIG. 4 showing a second embodiment of the suspension means that may also be employed with the embodiment of FIG. 1.

Shroud 2 includes a pair of extruded sections 5 and 6 each having optimum radius and wall thickness for applicable ice, wind and suspension characteristics. The sections 5 and 6 may be assembled by adhesive bonding at their mating surfaces, such as illustrated in FIG. 3, by means of mechanical fasteners such as bolts 7 and 8 illustrated in FIG. 2 accessible through openings 9 and 10, respectively, or by interlocking configurations in the two sections, such as illustrated in FIG. 5 at 11 and 12. When the shroud sections 5 and 6 are fastened together in a mating condition, a cavity 13 is provided therein to receive waveguide 3. Cavity 13 has a vertical dimension greater than the vertical dimension of waveguide 3 to permit the waveguide to maintain a patterned configuration under varying load conditions.

The suspension means includes a suspension link 14 which is attached to each end of each of the plurality of shrouds by a pivot means 15 having an indentation 16 therein to engage cable 1 and, hence, suspend each section of the shroud from cable 1, with the shroud, in turn, supporting its associated waveguide section 3. Suspension link 14 can be rotated about its pivot 15 to become self-storing during handling, storing and transport. A simple detent 17 engages indentation 16 to retain link 14 in the stored or transport attitude.

Referring to FIG. 4, a second embodiment of the protective sheathing is illustrated, including a plastic shroud 18 to encase each waveguide section 3. Plastic shroud 18 enables the support and protection of each waveguide section in the horizontal waveguide run and yet each shroud deflects appropriately under ice and wind load compatibly with the enclosed waveguide section.

The arrangement of FIG. 4 eliminates the need for flexible waveguide sections required by the metal shroud 2 of FIG. 1. In the case of the extruded plastic sections 5 and 6 of the shroud 18, the height or vertical dimension of the internal cavity 13 is increased to provide considerable vertical clearance.

An analysis has indicated that for a span of 44 feet with an installation sag of 24 inches, which is abnormally large since it was produced by an initial cable tension of only 200 pounds where 300 to 400 pounds are more reasonable and readily attained, the waveguide will hang freely, but supported, within shroud 18 and subjected to only the light stresses of its own catenary deformation. Under icing conditions, when shroud 18 is carrying the ice load and the suspension cable 1 is elongated and the sag increases, the plastic shroud 18 deflects correspondingly. Cable 1 is normally in a substantially catenary configuration with the waveguide sections 3 being suspended also in a substantially catenary configuration in the shroud 18. The shroud 18 is in a chordal configuration until waveguide sections 3 deflect excessively and until ice load deforms the shroud 18 to follow the configuration of the increasing cable sag which is also under an ice load.

Figure 2:
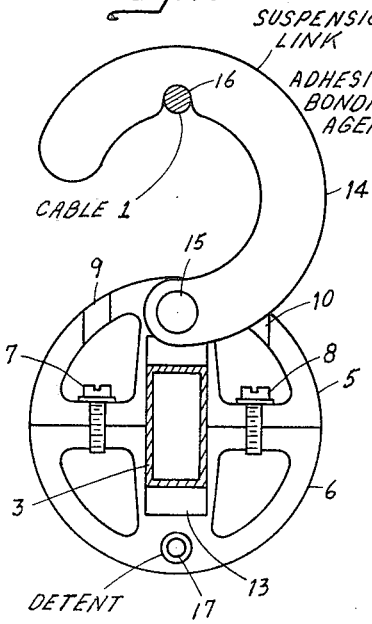
FIG. 2 is an end view taken along line 2—2 of FIG. 1.

As described hereinabove with respect to FIGS. 1–3, the extruded sections 5 and 6 of the plastic shroud 18 can be joined together in a mating relationship by an adhesive bonding agent as illustrated in FIG. 3, by screws or bolts as illustrated in FIG. 2, or by an interlocking configuration as illustrated in FIG. 5 at 11 and 12.

Figure 6:
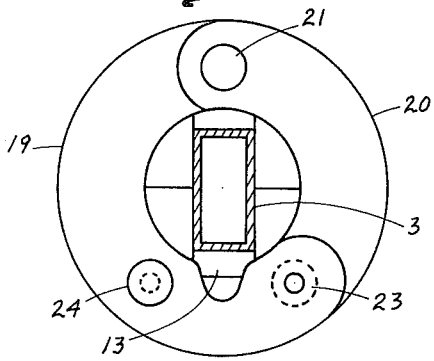
FIG. 6 is an end view of the arrangement of FIG. 4 with the suspension links in their transport position.

The plastic shroud 18 can be suspended by a suspension link as illustrated in FIG. 2, or it can employ the double link arrangement as illustrated to FIG. 5. The suspension means of FIG. 5 includes two links 19 and 20 pivotably connected at pivot 21 to each end of shroud 18. Links 19 and 20 are attached in opposed orientation at each end of shroud 18 with a thumb screw to form pivot 21. Each of links 19 and 20 have an indentation 22 to enclose cable 1 to preclude accidental disengagement of the waveguide sections 3 from the cable 1. Links 19 and 20 are retained in their support position by mating detents 23 and 24 which also retain the links 19 and 20 in their self-stored or trnsport position illustrated in FIG. 6.

Figure 7:
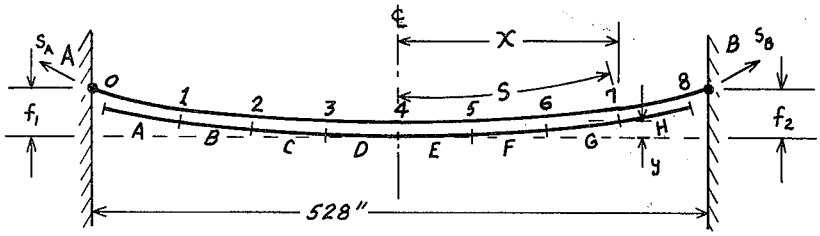
FIGS. 7–23 are useful in explaining the development of the protective sheathing to enable support and protection of the waveguide sections under the worst environmental conditions of a practical installation.

If cable 1, supporting eight lengths of waveguide section, is suspended from points of equal heights above ground, the lowest point of sag will occur at the center of the run as illustrated in FIG. 7. The connector or flange at this point and the waveguide sections D and E will be subject to maximum stress, since the maximum change in slope occurs there.

Figure 9:
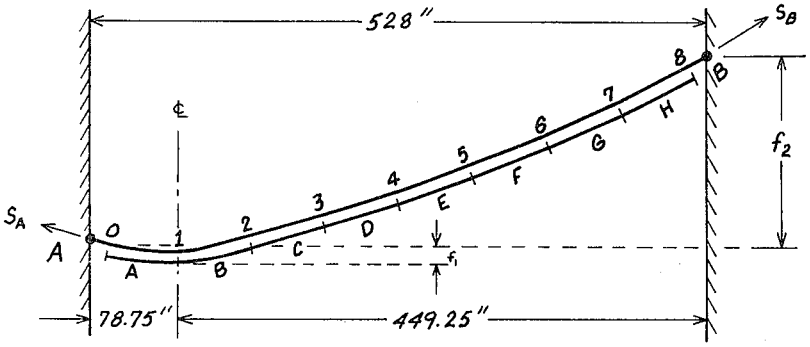

If cable 1 is suspended so that one point of support is elevated above the other, as it will be in some installations, then the point of maximum change in slope, or inflection, will shift from the center of the configuration depending upon the difference in elevation of the anchor points, in the tightness of cable 1 and in the amount of load, such as shown in FIG. 9.

The degree of bending at each flange is dependent upon the difference in slope between adjoining sections of waveguide and the deflection of composite structures between them. In a catenary configuration, the maximum bending moments may then occur at any point along a suspended waveguide run. The probable modes of failure for a composite waveguide section under these conditions are: (1) local buckling of the waveguide, (2) lateral buckling of the composite waveguide section; and (3) failure of the brazed flange joint. Failure due to local buckling seems remote, since the critical buckling stress is over 350,000 PSI for the waveguide.

Figure 8:
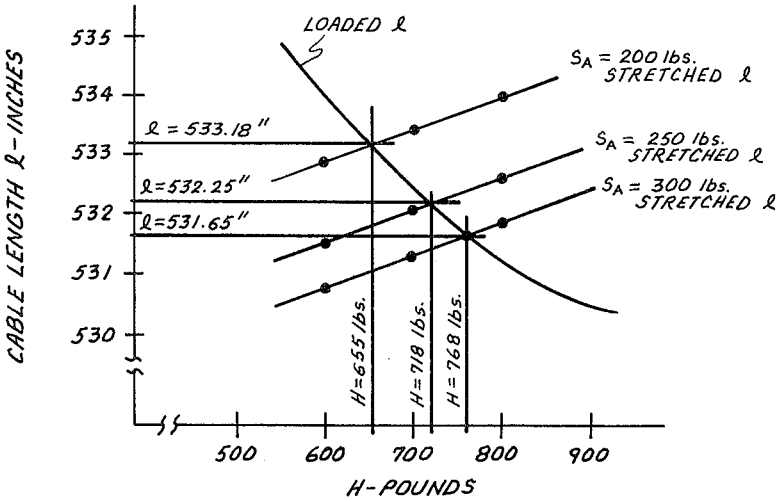

Referring to FIG. 7, the numbers along the waveguide array or run represent flange joints and the letters represent composite sections. Consider a catenary suspension where $f_1 = f_2$, the greatest effect of bending in the the waveguide array will occur at flange joint 4 and upon sections D and E. The graph of FIG. 8 is a summary of an analysis performed on the case illustrated in FIG. 7, which is a symmetrical arrangement with ice loading where there is 1 inch radial ice and the value of the load on the catenary suspension w is 9.60 pounds per inch rather than the value of 0.13 pounds per inch in an uniced condition.

Figure 10:
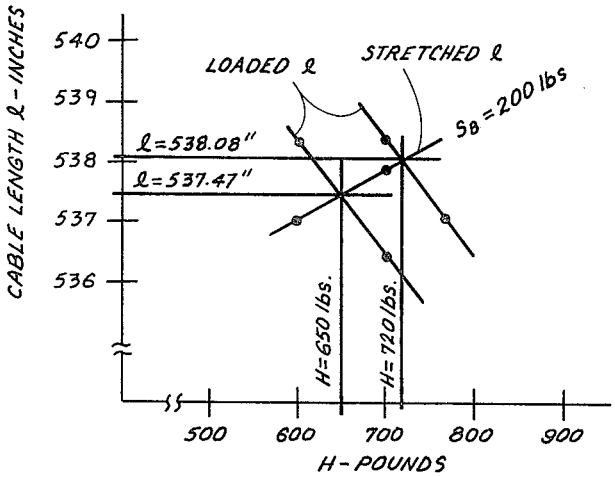

A second case to be considered is an unsymmetrical case where point B is raised above point A causing the inflection or vertex to shift correspondingly from the center flange shown in FIG. 7 toward the support point A as illustrated in FIG. 9. The worst case is shown in FIG. 9 where the anchor points are at unequal levels, and the inflection coincides with the first flange as shown in FIG. 9. At this point, the deformation of the waveguides and the stress in the flanges due to bending are maximum. A summary of the analysis of the condition of FIG. 9 is shown in FIG. 10 for H=650 pounds. This curve of the graph of FIG. 10 is for an unsymmetrical array with ice loading.

Figure 11:
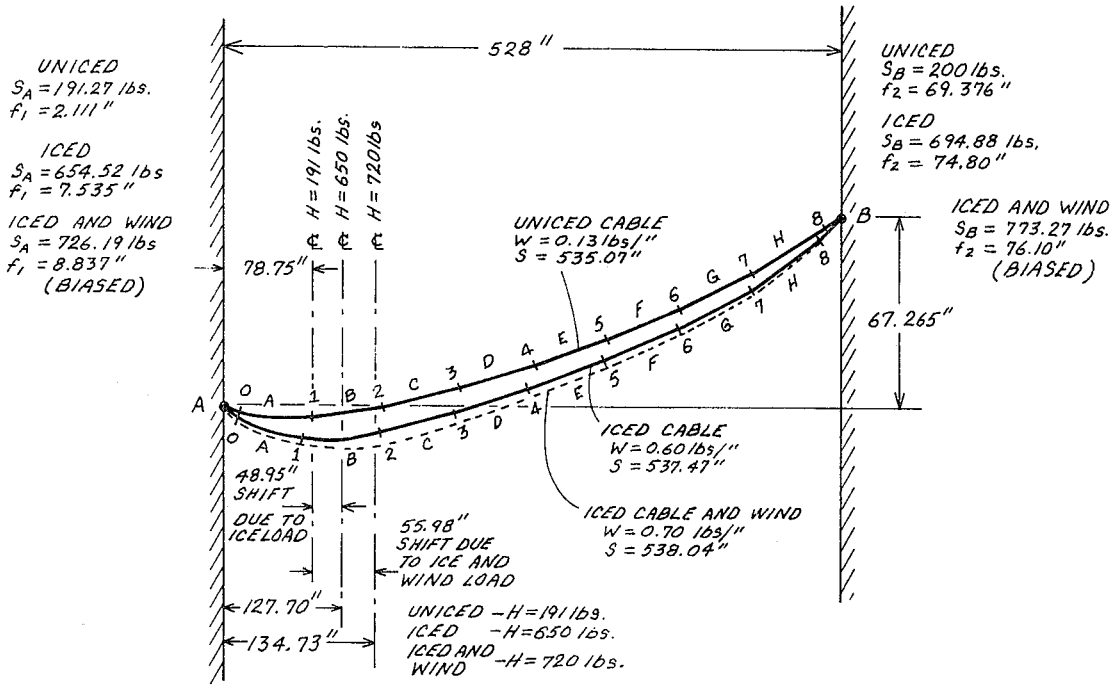

As mentioned hereinabove, the worst case for a waveguide loading in an unsymmetrical configuration occurred when the inflection coincided with the first flange as shown in FIG. 9. However, during icing, this inflection point migrates and the worst case is then found in a different configuration. This modified configuration is shown in FIG. 11 for H=650 pounds.

Figure 13:
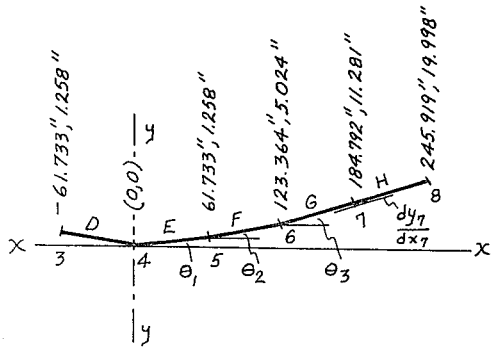
Figure 12:
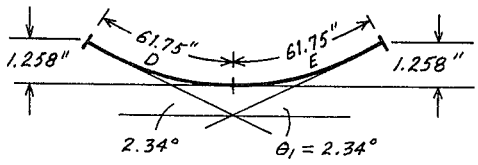

FIGS. 12 and 13 illustrate the values determined in an analysis of the worst case for an uniced symmetrical configuration.

Figure 14:
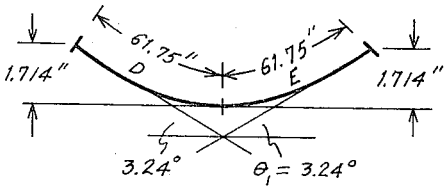
Figure 15:
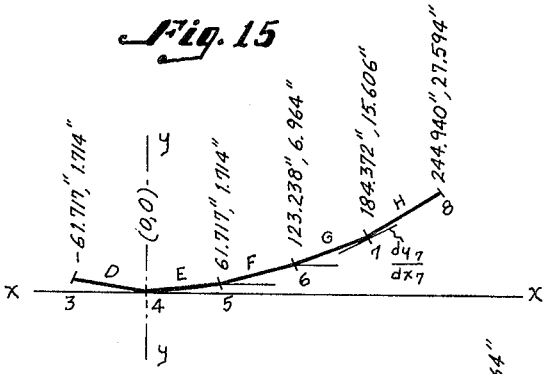

FIGS. 14 and 15 illustrate the results of an analysis for a worst case with an iced symmetrical configuration.

Figure 16:
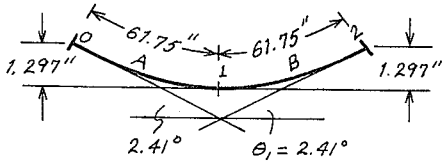
Figure 17:
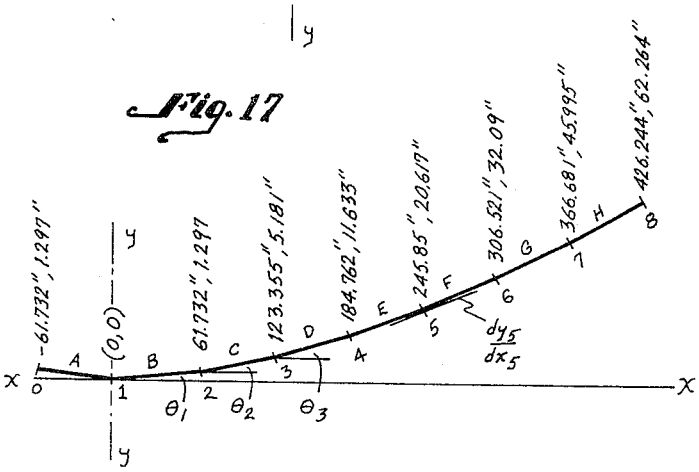
Figure 18:
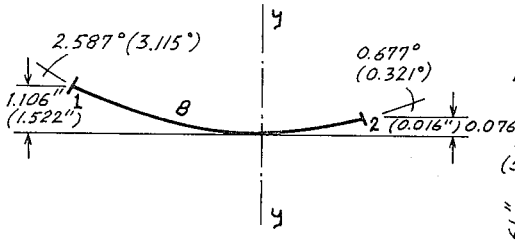
Figure 19:
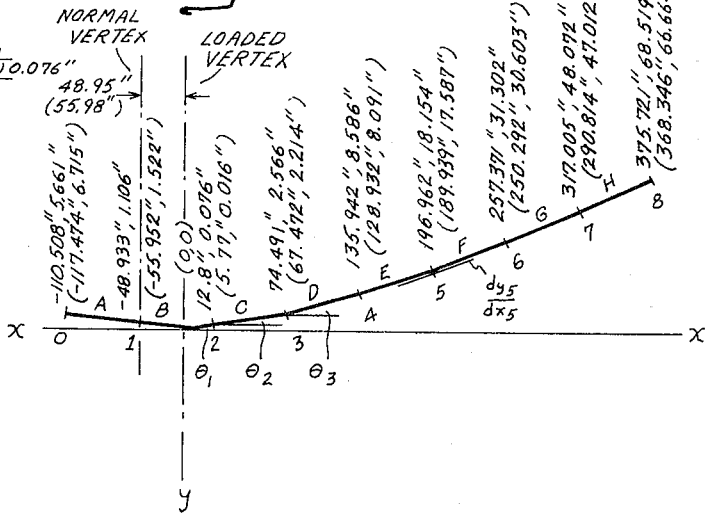

FIGS. 16 and 17 are curves illustrating the results of an analysis of the worst case uniced unsymmetrical configuration, while FIGS. 18 and 19 illustrate the results of an analysis of the worst case iced unsymmetrical configuration.

Figure 20:
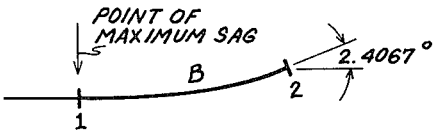

The foregoing analysis has indicated that the worst case of maximum deflection and the greatest bending stress in the waveguide will be found in the iced unsymmetrical array with a 200 pound initial cable tension. Accordingly, the waveguide section under greatest deflection and stress in the uniced, unsymmetrical arrangement is section B as illustrated in FIG. 20. The bending moments at each flange are proportional to the difference in change in slope at each flange.

$$\frac{M_1}{\Delta\theta_1} = \frac{M_2}{\Delta\theta_2} \quad M_1 = \frac{2.4067}{2.3982} M_2 = 1.0035\, M_2$$

Figure 21:
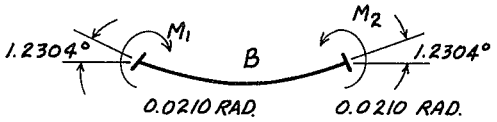
Figure 22:
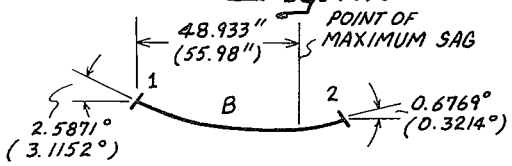
Figure 23:
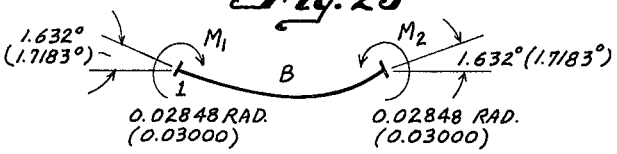

Since the difference is negligible for this component analysis, $M_1$ can be considered equal to $M_2$, which is shown in FIG. 21. In an uniced, unsymmetrical array the section B is as is shown in FIG. 22 and, here again, the difference between $M_1$ and $M_2$ is negligible and, therefore, $M_1$ can be considered equal to $M_2$ which is shown in FIG. 23.

Figure 24:
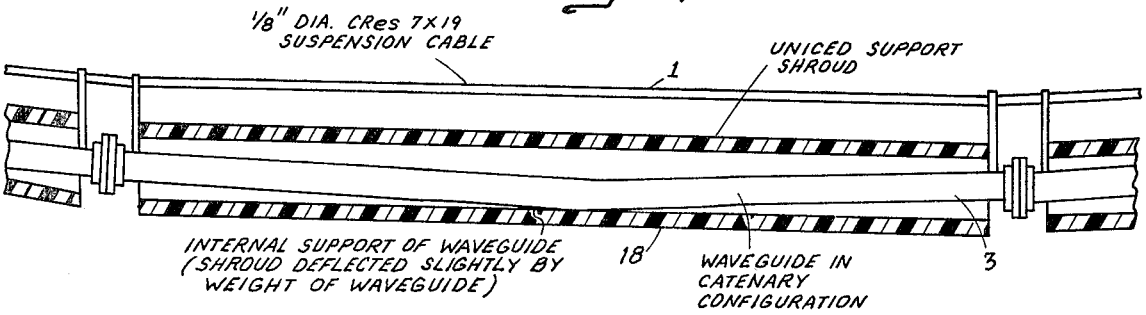
FIG. 24 is a cross sectional view of the suport and protection arrangement in an uniced condition.

As illustrated in FIG. 24, where the preferred protective plastic sheathing is used, the waveguide 3 is completely supported by plastic sheathing or shroud 18 in a small contact area in the center thereof and shroud 18 deflects slightly by the weight of the waveguide. Because of the intentional vertical elongation of the waveguide cavity 13, the waveguide section 3 is supported tangentially at the longitudinal center of each of shrouds 18.

Figure 25:
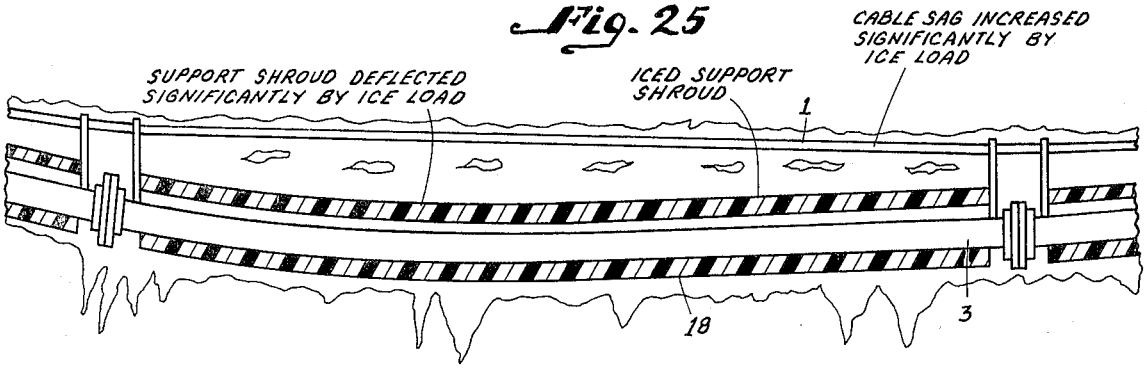
FIG. 25 is a cross sectional view of the support and protection arrangement illustrating the relationship between the waveguide and the shroud in an iced condition.

When the arrangement of FIG. 24 is subjected to an ice load, shroud 18 deflects significantly such that waveguide sections 3 and shrouds 18 are in contact over a significant length thereof as illustrated in FIG. 25 with both waveguide sections 3 and shrouds 18 maintaining a substantially catenary configuration.

Assuming, for the moment, that the plastic shroud 18 is completely rigid and demonstrates no deflection under a load, sufficient vertical elongation of the cavity 13 is very practical in the proposed construction to support the waveguide section in an uniced condition without encountering any physical interferences to distort the natural catenary configuration.

However, the plastic shroud 18 is not rigid, but has a modulous of elasticity sufficiently low so as to promise beneficial features in this application. A cross sectional configuration is possible in which the section of the shroud will deflect under ice load proportional with increasing sag of cable 1. This will encourage the retention of a catenary form for the waveguide array without introducing interferences, distortions or concentrated stresses in the waveguide sections.

Figure 26:
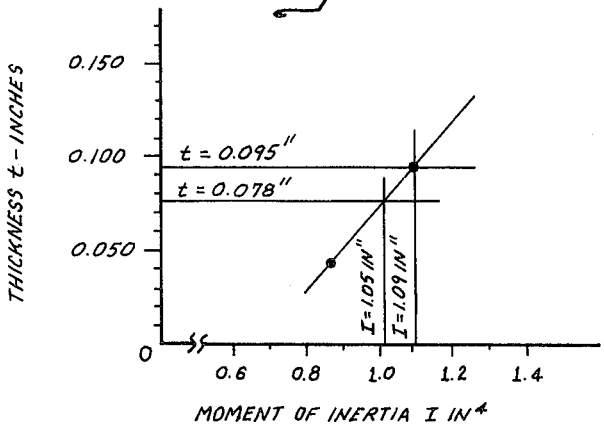
FIG. 26 is a graph illustrating the necessary thickness t for the shroud when an ice load is present and also the thickness t necessary to support an ice load as well as a wind load with the latter being the required thickness t for the total of ice and wind load; in other words, the worst environmental condition.

A clear understanding of this concept may be had by observing the illustrations of FIGS. 24 and 25 and the graph of FIG. 26.

The need for a cable support for the waveguide span is readily apparent. If an eight section array of WR75 hard-drawn copper waveguide, each at 61.75 inches, were to be joined and supported at its end as a simple beam, the natural deflection due to its weight would be 241 inches.

Since there are flanges at the ends of each section that are brazed to the waveguide, two or three inches of waveguide adjoining each flange is annealed so that it would yield or deform at 10,000 PSI. Consequently, the maximum permissible deflection or sag for an assembled eight-section waveguide span before permanent deformation occurs can be 48 inches. Obviously, the waveguide would be permanently deformed in such an arrangement.

The selected minimum nominal cable tension of 200 pounds permits a maximum deflection of 27.6 inches under ice conditions. Permanent deformation of the waveguide section should not occur under this condition.

The preceding analysis has used the probable worst case of flow initial cable tension and icing conditions for an unsymmetrical array to determine the cross section of a compatible shroud or sheathing. However, to finalize the cross sectional construction of the protective shroud 18, the supplemental load of wind must be considered.

Let us assume that there is a 60 mile per hours wind load.

For a lowest installed tension of 200 pounds, the initial cable length for the worst unsymmetrical array was found to be 535.07 inches with an H value of 191 pounds and a load w=0.13 pounds per inch. During icing, this cable stretched to 537.47 inches with an H value of 650 pounds and a w=0.60 pounds per inch, see FIG. 11. When a constant wind load of 60 miles per hour is superimposed upon this iced configuration the results of the analysis are shown in FIG. 11 and in FIG. 10 for an H=720 pounds.

It was noted hereinabove that the worst case for a waveguide loading in an unsymmetrical, uniced configuration occurred when the inflection coincided with the first flange as shown in FIG. 9. During icing, this inflection migrated to a different location by 48.95 inches. With both, ice and wind loads, further migration occurs to produce a different configuration that is illustrated in FIG. 11 with a 55.98 inch shift due to ice and wind load with H=720 pounds.

FIG. 26 illustrates a curve for the thickness t as defined in FIG. 5 with a case where the arrangement is loaded with both ice and wind where t=0.095 inches to produce the moment of inertia associated with this load.

The plastic that can be employed for the sheath 18 is a glass-filled plastic which may be obtained from General Electric Company, identified as NORYL ENG 265, which will take a stress of 6,000 pounds.

Predicated upon a yield strength of 10,000 PSI, the maximum permissible deflection or sag for an assembled eight-section waveguide span before permanent deformation occurs is found to be 48 inches. The selected minimum nominal cable tension of 200 pounds permits a maximum deflection of 32.3 inches under ice and wind conditions. Permanent deformation of the waveguide section should not occur under these conditions.

It is to be noted that, for an initial installation cable tension of 200 pounds, the maximum cable tension under the worst ice and wind loading rises to 733 pounds. Relating this to the maximum breaking strength of 1760 pounds for the cable 1, the factor of safety is above 2.

Since the cable tension increases about four times when ice and wind loading is applied to the array, the upper limit for installing tension can be 1760 divided by 4, or 440 pounds. The maximum installing tension of 300 pounds is recommended, offering a factor of safety of 0.5 for the cable.

Predicated upon the worst case of eight sections of waveguide being suspended from cable 1 from the shelter to the antenna mast and with the configuration for shroud 18 of NORYL ENG 265 of 0.090 inch wall, it is recommended that in all cases the initial cable tension be held within 200 to 300 pounds. This value can easily be measured with a small economical tensiometer.

Under these conditions, the initial minimum tension of 200 pounds will increase toward 800 pounds, with a factor of safety of 2.0 for the cable and 1.5 for the waveguide. The initial maximum tension of 300 pounds will increase toward 1200 pounds with a factor of safety of 1.5 for the cable and 2.0 for the waveguide.

While I have described above the principles of my invention in connection with specific apparatus, it is to be clearly understood that this description is made only by way of example and not as a limitation to the scope of my invention as set forth in the objects thereof and in the accompanying claims.

I claim:

1. An arrangement to support and protect a horizontal waveguide having a plurality of waveguide sections connected to each other in tandem suspended between two given spaced points above ground comprising:

a cable extending between said two points;

a plurality of shrouds each encasing a substantial length of a different one of said plurality of sections for support and protection thereof; and a suspension means fastened to each end of each of said plurality of shrouds to suspend each of said plurality of sections from said cable.

2. An arrangement according to claim 1, wherein each of said plurality of shrouds includes two symmetrical halves which mate to one another to provide a cavity therein to receive an associated one of said plurality of sections.

3. An arrangement according to claim 2, wherein each of said cavities has a given vertical dimension greater than a vertical dimension of said associated one of said plurality of sections to enable said waveguide to assume and retain a catenary configuration under varying load conditions when suspended between said two points.

4. An arrangement according to claim 3, further including connection means to releasably connect said two halves together to provide said cavity.

5. An arrangement according to claim 4, wherein said connection means includes at least two mechanical fasteners.

6. An arrangement according to claim 5, wherein each of said two mechanical fasteners are located adjacent a different one of two access openings in the outer surface of one of said two halves.

7. An arrangement according to claim 3, further including connection means to connect said two halves together to provide said cavity.

8. An arrangement according to claim 7, wherein said connection means includes a bonding agent.

9. An arrangement according to claim 7, wherein said connection means includes an interlocking configuration formed on each of said two halves.

10. An arrangement according to claims 4 or 7, wherein said suspension means is pivotably fastened to each end of one of said two halves.

11. An arrangement according to claim 10, wherein each of said suspension means is rotatable to a transport position defined by the outer circumference of said two halves.

12. An arrangement according to claim 11, wherein each of said suspension means is held in said transport position by detent means associated with the other of said two halves.

13. An arrangement according to claim 12, wherein each of said suspension means includes a single suspension link having one end thereof pivotably connected to said one of said two halves and an indentation adjacent the other end thereof to engage said cable.

14. An arrangement according to claim 13, wherein said detent means include a member fastened to said other of said two halves engaged by said indentation when said single link is disposed in said transport position.

15. An arrangement according to claim 11, wherein each of said suspension means includes a pair of suspension links having opposite orientation, one end of each of said pair of links being rotatably connected to said one end of said two halves, each of said pair of links having an indentation adjacent the other end thereof to engage said cable.

16. An arrangement according to claim 15, wherein each of said pair of links is held in said transport position by detent means associated with each of said pair of links disposed adjacent said other end thereof.

17. An arrangement according to claim 16, wherein said detent means hold each of said pair of links in a captive attitude when said indentations are in engagement with said cable.

18. An arrangement according to claims 3 or 4, wherein a bottom surface of each of said plurality of sections bears against a bottom surface of said cavity of an associated one of said plurality of shrouds when said arrangement is subjected to a predetermined maximum load condition.

19. An arrangement according to claims 3 or 4, wherein a central portion of a bottom surface of each of said plurality of sections bears against a bottom surface of said cavity of an associated one of said plurality of shrouds when said arrangement is subjected to a predetermined load condition less than a given maximum load condition.

20. An arrangement according to claims 1, 2, 3, 4 or 7, wherein each of said plurality of shrouds is a metallic shroud and each of said plurality of sections is connected to the adjacent one of said plurality of sections by a flexible waveguide section.

21. An arrangement according to claims 1, 2, 3, 4 or 7, wherein each of said plurality of shrouds is a resilient plastic shroud.

22. An arrangement according to claim 21, wherein each of said plastic shrouds is a glass-filled plastic shroud.

23. An arrangement according to claim 10, wherein each of said plurality of shrouds is a metallic shroud and each of said plurality of sections is connected to the adjacent one of said plurality of sections by a flexible waveguide section.

24. An arrangement according to claim 10, wherein each of said plurality of shrouds is a resilient plastic shroud.

25. An arrangement according to claim 24, wherein each of said plastic shrouds is a glass-filled plastic shroud.

26. An arrangement according to claim 11, wherein each of said plurality of shrouds is a metallic shroud and each of said plurality of sections is connected to the adjacent one of said plurality of sections by a flexible waveguide section.

27. An arrangement according to claim 11, wherein each of said plurality of shrouds is a resilient plastic shroud.

28. An arrangement according to claim 27, wherein each of said platic shrouds is a glass-filled plastic shroud.

29. An arrangement according to claim 12, wherein each of said plurality of shrouds is a metallic shroud and each of said plurality of sections is connected to the adjacent one of said plurality of sections by a flexible waveguide section.

30. An arrangement according to claim 12, wherein each of said plurality of shrouds is a resilient plastic shroud.

31. An arrangement according to claim 30, wherein each of said plastic shrouds is a glass-filled plastic shroud.

32. A protective sheathing for a waveguide including a plurality of waveguide sections to be connected to each other in tandem and suspended above ground between two given spaced points comprising:

a plurality of shrouds each encasing the length of a different one of said plurality of sections, each of said plurality of shrouds including two symmetrical halves which mate to one another to provide a cavity therein to loosely receive an associated one of said plurality of sections.

33. A sheathing according to claim 32, wherein each of said cavities has a given vertical dimension greater than a vertical dimension of said associated one of said plurality of sections to enable said waveguide to assume and retain a catenary configuration under varying load conditions when said plurality of sections are connected to each other and is suspended between said two points.

34. A sheathing according to claim 33, further including connection means to releasably connect said two halves together to provide said cavity.

35. A sheathing according to claim 34, wherein said connection means includes at least two mechanical fasteners.

36. A sheathing according to claim 35, wherein each of said two mechanical fasteners are located adjacent a different one of two access openings in the outer surface of one of said two halves.

37. A sheathing according to claim 33, further including connection means to connect said two halves together to provide said cavity.

38. A sheathing according to claim 37, wherein said connection means includes a bonding agent.

39. A sheathing according to claim 37, wherein said connection means includes an interlocking configuration formed on each of said two halves.

40. A sheathing according to claims 34 or 37, further including suspension means pivotably fastened to each end of one of said two halves to suspend each of said plurality of shrouds from a suspension cable, each of said suspension means being rotatable to a transport position defined by the outer circumference of said two halves.

41. A sheathing according to claim 40, wherein each of said suspension means is held in said transport position by detent means associated with the other of said two halves.

42. A sheathing according to claim 41, wherein each of said suspension means includes a single suspension link having one end thereof pivotably connected to said one of said two halves and an indentation adjacent the other end thereof to engage said cable.

43. A sheathing according to claim 42, wherein said detent means include a member fastened to said other of said two halves engaged by said indentation when said single link is disposed in said transport position.

44. A sheathing according to claim 40, wherein each of said suspension means includes a pair of suspension links having opposite orientation, one end of each of said pair of links being rotatably connected to said one end of said two halves, each of said pair of links having an indentation adjacent the other end thereof to engage said cable.

45. A sheathing according to claim 44, wherein each of said pair of links is held in said transport position by detent means associated with each of said pair of links disposed adjacent said other end thereof.

46. A sheathing according to claim 45, wherein said detent means hold each of said pair of links in a captive attitude when said indentations are in engagement with said cable.

47. A sheathing according to claims 32, 33, 34 or 37, wherein each of said plurality of shrouds is a metallic shroud and each of said plurality of sections is connected to the adjacent one of said plurality of sections by a flexible waveguide section.

48. A sheathing according to claims 32, 33, 34 or 37, wherein each of said plurality of shrouds is a resilient plastic shroud.

49. A sheathing according to claim 48, wherein each of said plastic shrouds is a glass-filled plastic shroud.

50. An arrangement according to claim 40, wherein each of said plurality of shrouds is a metallic shroud and each of said plurality of sections is connected to the adjacent one of said plurality of sections by a flexible waveguide section.

51. An arrangement according to claim 40, wherein each of said plurality of shrouds is a resilient plastic shroud.

52. An arrangement according to claim 51, wherein each of said plastic shrouds is a glass-filled plastic shroud.

53. An arrangement according to claim 41, wherein each of said plurality of shrouds is a metallic shroud and each of said plurality of sections is connected to the adjacent one of said plurality of sections by a flexible waveguide section.

54. An arrangement according to claim 41, wherein each of said plastic shrouds is a resilient plastic shroud.

55. An arrangement according to claim 54, wherein each of said plastic shrouds is a glass-filled plastic shroud.

* * * * *